US008308316B2

(12) United States Patent
Sparrow

(10) Patent No.: US 8,308,316 B2
(45) Date of Patent: Nov. 13, 2012

(54) LAMP

(76) Inventor: Roger Lionel David Sparrow, Petworth (GB)

( * ) Notice: Subject to any disclaimer, the term of this patent is extended or adjusted under 35 U.S.C. 154(b) by 631 days.

(21) Appl. No.: 12/549,880

(22) Filed: Aug. 28, 2009

(65) Prior Publication Data

US 2010/0052551 A1 Mar. 4, 2010

(30) Foreign Application Priority Data

Aug. 29, 2008 (GB) ..... 0815772.9

(51) Int. Cl.
*F21L 4/08* (2006.01)

(52) U.S. Cl. ..... 362/183; 362/249.05

(58) Field of Classification Search ..... 362/183, 362/249.02, 249.05, 249.12
See application file for complete search history.

(56) References Cited

U.S. PATENT DOCUMENTS

| | | | | |
|---|---|---|---|---|
| 2006/0082991 | A1 | 4/2006 | Hrabal | |
| 2007/0285053 | A1* | 12/2007 | Noguchi et al. | 320/114 |
| 2007/0297167 | A1 | 12/2007 | Greenhoe | |
| 2011/0199757 | A1* | 8/2011 | Cheng | 362/183 |
| 2011/0216529 | A1* | 9/2011 | Weng | 362/183 |

* cited by examiner

*Primary Examiner* — David V Bruce
(74) *Attorney, Agent, or Firm* — Jennifer Meredith, Esq.; Meredith & Keyhani, PLLC

(57) ABSTRACT

A lamp has a power management circuit 11. It includes an integrated circuit 12 for control of the lamp. The IC can be controlled by operation of a switch 7 to apply a voltage on line 10 30 switch on the transistor 26.

19 Claims, 2 Drawing Sheets

LAMP

This application claims priority to application number 0815772.9 filed Aug. 29, 2008 in the United Kingdom, the entire contents of which is incorporated by reference.

The present invention relates to a lamp.

The object of the present invention is to provide an improved lamp.

According to the invention there is provided a lamp adapted to power itself and an external device from its own internal battery, the lamp comprising:

a housing;

a light emitting device mounted on the housing;

a battery mounted within the housing;

a port for charging the battery mounted on the housing;

a switch for switching on/off the light emitting device;

means for supplying electric current from the battery for external use.

Whilst it can be envisaged that the external use supply means may be an auxiliary port, in particular connected in parallel with the charging port; in the preferred embodiment, the said means is connected to supply externally via the charging port.

In the preferred embodiment, the external power supply means includes means for selectively connecting the charging port to the battery.

Preferably:

the selective connection means is arranged to isolate the port from the battery except in desired circumstances of either connection to the port of a battery charging voltage or connection to the port of an external device to be powered;

the selective connection means includes a switch for switching one contact of the port, which is normally-isolated from the battery, to the latter and is adapted to detect a charging voltage at the port greater than the battery voltage and to effect the switching in response to such detection;

the switch is a transistor switch and the selective connection means includes an operational amplified arranged to change state on detection of the charging voltage and apply a voltage to the base of the transistor for effecting the switching;

the lamp includes a current limiting resistance connecting the battery across the port;

the lamp includes a microprocessor adapted to receive lamp control signals via the switch and to cause the selective connection means to connect the battery directly across the port, the connection being by the transistor where provided;

the microprocessor is further adapted to receive a signal from the selective connection means on detection of a load impedance or a short circuit at the port and treat this as a logical signal for controlling the lamp;

the microprocessor is adapted and arranged to supply a pulse width modulated signal for controlling supply of power to the light emitting device;

the lamp includes a transistor switch in series with the light emitting device between the battery terminals, the transistor being switched by the pulse width modulated signal in use;

the microprocessor is adapted to control brightness of the light emitting device by modification of the pulse width in accordance with a code of operation of the switch;

the lamp includes circuit for modifying the pulse width in accordance with detected battery voltage;

the lamp includes a circuit for modifying the pulse width in accordance with detected lamp temperature;

the lamp includes a circuit for modifying the pulse width in accordance with detected light emitting device current; and the light emitting device is a light emitting diode.

To help understanding of the invention, a specific embodiment thereof will now be described by way of example and with reference to the accompanying drawings, in which.

Figure 1:
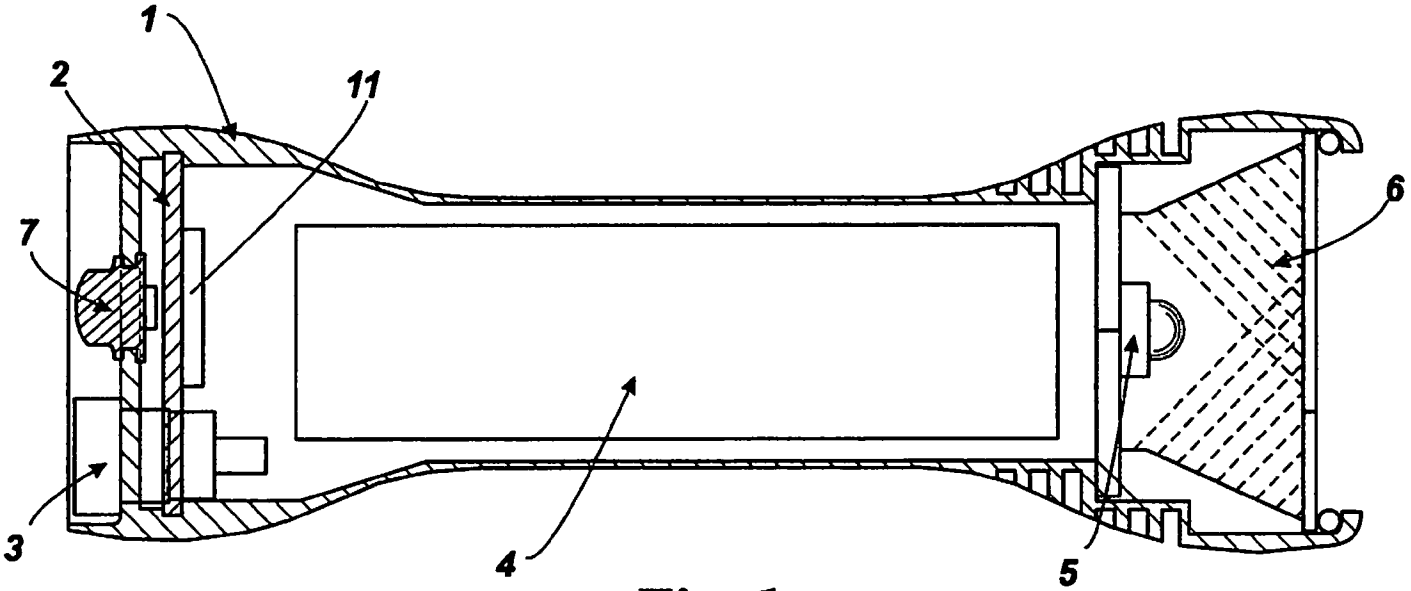
FIG. 1 is a diagrammatic cross-sectional view of a lamp in accordance with the invention.
Figure 3:
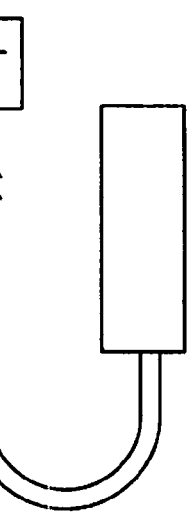
FIG. 3 is a diagrammatic view of an auxiliary switch for the lamp of FIG. 1.
Figure 4:
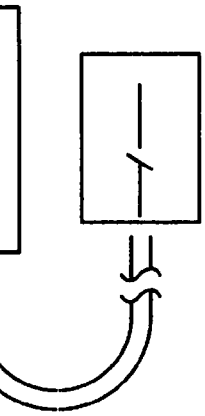
FIG. 4 is a diagrammatic view of a sequencer for the lamp of FIG. 1.

Referring to the drawings, a lamp has a body 1, in which is mounted a printed circuit board 2, to which is connected amongst other components a charging port 3. A battery 4 is housed in the body, which also carries a light emitting diode 5 and a reflector 6 at the end opposite from the port 3. Adjacent the port is a press button switch 7. FIG. 1 is diagrammatic, insofar for instance as wiring is not shown.

Figure 2:
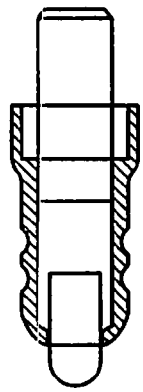
FIG. 2 is a diagrammatic view of an auxiliary lamp for the lamp of FIG. 1.
Figure 5:
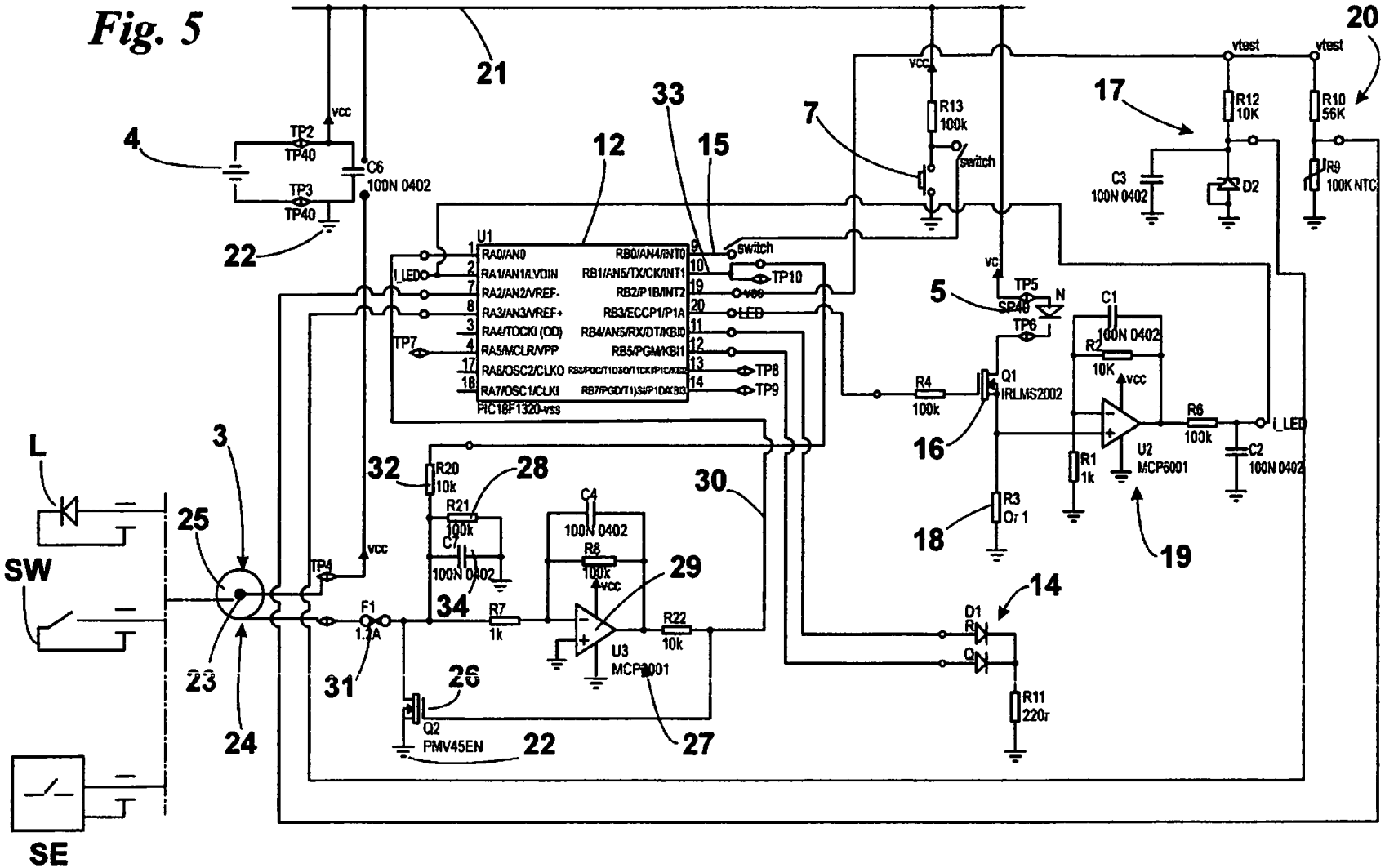
FIG. 5 is a circuit diagram of the lamp of FIG. 1.

Turning to FIG. 2, a power management circuit 11, mounted in physical form on the PCB 2, has a programmed microprocessor/integrated circuit 12 of the PIC18F1320-1/SS type. It is programmed in accordance with the description below, but could be programmed with differences in detail.

The port 3, the battery 4, the LED 5 and the switch 7 are connected to the circuit. The switch incorporates a bi-colour LED 14 powered by the IC 12 to indicate battery state and the state of powering of the lamp. The switch itself is connected to ground an input terminal 15 of the IC for controlling it.

The LED is switched on by applying a voltage to the base of a switching field effect transistor 16 in series with its earth connection. Brightness of the LED is controlled by pulse width modulation, that is controlling proportion of the time that it is switched on, that is the proportion of the time that current is actually flowing through it. To maintain the brightness constant, the IC is provided with a battery voltage measuring circuit 17 and is programmed to adjust the pulse width of current supply for desired brightness. The actual current is measured in terms of voltage across a resistor 18 in series with the transistor 16, the voltage being measured by the amplifier circuit 19 and fed back to the IC for control of the pulse width. A temperature measuring circuit 20 is provided to reduce the current in the event of LED resistance drop to avoid thermal run away. The IC can be programmed to reduce the brightness in event that the temperature rises unacceptably.

The battery is connected between a positive voltage line 21 and local earth 22 in the lamp. The central contact 23 of the port 24 is connected to the voltage line 21, i.e. to the positive battery terminal, but the outer contact 25 is not connected directly to earth. This to protect the battery from accidental short circuiting. In order to allow the battery to be charged, a field effect transistor switch 26 is provided, associated with a detection circuit 27. Normally the outer contact will be grounded via a high resistance (100 k) 28. When a charger voltage C, as opposed to a short circuit, is applied to the port 3, the input to the operational amplifier 29 in the detection circuit will have the polarity of its inputs reversed. It will change state, causing a positive voltage on its output and activate the switch 26 to provide a return path for the charging current via the local earth. The positive voltage is passed to the IC on line 30, causing the switch LED 14 to flash green, indicating charging. The lamp can still be used in this state, as when it is being used in conjunction with a back-up battery pack (not shown).

If an auxiliary load L is applied to the port, a route to ground is provided via the resistance 28. Thus a low voltage is applied across the load, assuming the load to be of lower resistance than the resistance 28.

The IC can be controlled by operation of the switch to apply a voltage on line 30 switch on the transistor 26. Thus the load can be powered at full battery voltage. A fuse 31 is provided to protect against excessive current drain. Where as preferred the battery is a Lithium Ion battery it will be provided with its own internal battery protection circuit.

If an auxiliary switch SW is applied to the port, its operation can be detected via protection resistance 32. When the switch is open circuit, input 33 to the IC is grounded. When the switch is closed, voltage is applied to the contact. The IC is programmed to detect control inputs in this way. A capacitor 34 is connected across resistance 28 to guard against accidental static voltage being applied to input 33

For special operation of the lamp, a sequencer SE, that is a device able to apply a coded sequence of switch operation, can be connected to the port to apply specific control signals to the lamp via the port.

By way of example, the lamp can have the following switch actuation protocol:

1. Double click to switch ON at full brightness—switch LED green;
2. Single subsequent click to medium brightness—switch LED orange;
3. Single subsequent click to low brightness—switch LED red;
4. Single subsequent click to full brightness—switch LED green;
5. Long subsequent click to flash—switch LED green;
6. Held subsequent click to switch off.

The port is permanently live for low power via resistance 28. Full battery voltage is applied as follows:

11. Long held click to cause fast click sequence and subsequent double click to switch on both main light and for example an auxiliary light plugged into the port;
12. Held subsequent click to switch off.

The invention is not intended to be restricted to the details of the above described embodiment. For instance, other control sequences are possible.

The invention claimed is:

1. A lamp adapted to power itself and an external device from its own internal battery, the lamp comprising:

a housing;

a light emitting device mounted on the housing;

a battery mounted within the housing;

a charging port for charging the battery mounted on the housing;

a switch for switching on/off the light emitting device;

a current supply circuit for supplying electric current from the battery for external use through the charging port;

a charge supply circuit for receiving supply of electric current from an external source through the charging port;

a selective connection means for selectively connecting the charging port to the current supply circuit or the charge supply circuit.

2. A lamp according to claim 1, wherein the external power supply means includes an auxiliary external power supply port.

3. A lamp according to claim 2, wherein the external power supply port is connected to the charging port in parallel therewith.

4. A lamp according to claim 1, wherein the selective connection means is arranged to isolate the port from the battery except in desired circumstances of either connection to the port of a battery charging voltage or connection to the port of an external device to be powered.

5. A lamp according to claim 4, wherein the selective connection means includes a switch for switching one contact of the port, which is normally-isolated from the battery, to the latter and is adapted to detect a charging voltage at the port greater than the battery voltage and to effect the switching in response to such detection.

6. A lamp according to claim 5, wherein the switch is a transistor switch and the selective connection means includes an operational amplified arranged to change state on detection of the charging voltage and apply a voltage to the base of the transistor for effecting the switching.

7. A lamp according to claim 1, including a current limiting resistance connecting the battery across the port.

8. A lamp according to claim 1, including a microprocessor adapted to receive lamp control signals via the switch and to cause the selective connection means to connect the battery directly across the port, the connection being by the transistor where provided.

9. A lamp according to claim 8, wherein the microprocessor is further adapted to receive a signal from the selective connection means on detection of a load impedance or a short circuit at the port and treat this as a logical signal for controlling the lamp.

10. A lamp according to claim 8, wherein the microprocessor is adapted and arranged to supply a pulse width modulated signal for controlling supply of power to the light emitting device.

11. A lamp according to claim 10, including a transistor switch in series with the light emitting device between the battery terminals, the transistor being switched by the pulse width modulated signal in use.

12. A lamp according to claim 10, wherein the microprocessor is adapted to control brightness of the light emitting device by modification of the pulse width in accordance with a code of operation of the switch.

13. A lamp according to claim 10, including a circuit for modifying the pulse width in accordance with detected battery voltage.

14. A lamp according to claim 10, including a circuit for modifying the pulse width in accordance with detected lamp temperature.

15. A lamp according to claims 10, including a circuit for modifying the pulse width in accordance with detected light emitting device current.

16. A lamp according to claim 1, wherein the light emitting device is a light emitting diode.

17. A lamp according to claim 1, in combination with an auxiliary lamp adapted to be connected to the port.

18. A lamp according to claim 1, in combination with an auxiliary switch adapted to be connected to the port.

19. A lamp according to claim 1, in combination with a sequencer adapted to be connected to the port.

* * * * *